US010976694B2

(12) United States Patent
Hyodo et al.

(10) Patent No.: US 10,976,694 B2
(45) Date of Patent: Apr. 13, 2021

(54) IMAGE FORMING APPARATUS WITH A FIRST DOOR AND SECOND DOOR FOR ACCESSING A CARTRIDGE

(71) Applicant: CANON KABUSHIKI KAISHA, Tokyo (JP)

(72) Inventors: Taisuke Hyodo, Susono (JP); Joji Goto, Susono (JP); Takashi Kuwata, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/789,654

(22) Filed: Feb. 13, 2020

(65) Prior Publication Data

US 2020/0257237 A1 Aug. 13, 2020

(30) Foreign Application Priority Data

Feb. 13, 2019 (JP) ..... JP2019-023106

(51) Int. Cl.
*G03G 21/16* (2006.01)
*G03G 15/16* (2006.01)
*G03G 21/18* (2006.01)

(52) U.S. Cl.
CPC ..... *G03G 21/1633* (2013.01); *G03G 15/161* (2013.01); *G03G 21/1853* (2013.01)

(58) Field of Classification Search
CPC ..... G03G 21/1633; G03G 15/161; G03G 21/1853; G03G 2221/169; G03G 21/12
See application file for complete search history.

(56) References Cited

U.S. PATENT DOCUMENTS

| | | | | |
|---|---|---|---|---|
| 7,672,627 | B2 * | 3/2010 | Suzuki | G03G 15/80 399/110 |
| 10,216,137 | B2 | 2/2019 | Agata et al. | |
| 2009/0016768 | A1 * | 1/2009 | Seorl | G03G 21/1633 399/107 |
| 2009/0028601 | A1 * | 1/2009 | Mizuno | G03G 21/185 399/111 |
| 2011/0058825 | A1 | 3/2011 | Tsukijima | |

FOREIGN PATENT DOCUMENTS

| | | |
|---|---|---|
| JP | 2011-59296 A | 3/2011 |

* cited by examiner

*Primary Examiner* — Sandra Brase
(74) *Attorney, Agent, or Firm* — Venable LLP

(57) ABSTRACT

An image forming apparatus includes a cartridge, a first door, and a second door. The first door is movable between a first closed position and a first open position to permit dismounting the cartridge from the main. The second door is movable, independently of the first door, between a second closed position for closing the main assembly and a second opened position for uncovering the first door and for opening the main assembly. The second door is provided with a recess. When the first door is in the first open position, the recess of the second door is capable of accommodating at least a part of the first door. The cartridge is capable of being inserted into the main assembly while sliding on the second door and then on the first door.

13 Claims, 10 Drawing Sheets

IMAGE FORMING APPARATUS WITH A FIRST DOOR AND SECOND DOOR FOR ACCESSING A CARTRIDGE

FIELD OF THE INVENTION AND RELATED ART

The present invention relates to an image forming apparatus such as an electrophotographic copying machine, and an electrophotographic printing machine (laser beam printer, an LED printer, etc.).

Generally speaking, electrophotographic image forming apparatuses are provided with a door which can be opened or closed by a user to access its process cartridges or the like consumable to replace the consumables. However, there are occasions when it is desired that the replacement of specific consumables and/or replacement of consumables by specific persons, are regulated.

Thus, there have been known image forming apparatuses designed to deal with these issues. For example, there has been known an image forming apparatus (Japanese Laid-open Patent Application No. 2011-59296), which is provided with a combination of an inner door and a locking mechanism, which is disposed in the adjacencies of the cartridge insertion opening. The locking mechanism is for keeping the inner door locked in the closed state.

This image forming apparatus is provided with both an outer door and an inner door which can be individually opened or closed from each other. Therefore, if it is necessary to replace its cartridge (one of its cartridges), the inner door has to be opened after the outer door is opened. The image forming apparatus and the cartridges therefor are structured so that when each cartridge is inserted into the main assembly of the apparatus, it has to be kept in a specific attitude. Therefore, there has been desired an image forming apparatus and cartridges therefor, which are substantially superior to any conventional image forming apparatus and cartridges therefor, in terms of efficiency with which the cartridges can be replaced.

SUMMARY OF THE INVENTION

The present invention was made in consideration of the current issue described above. Therefore, the primary object of the present invention is to provide an image forming apparatus which is substantially superior to any conventional image forming apparatus in terms of maintenance efficiency.

According to an aspect of the present invention, there is provided an image forming apparatus including a cartridge, a first door, and a second door. The cartridge is detachably mountable to a main assembly of the image forming apparatus and includes a photosensitive member and a cleaning member. The cleaning member is configured to remove toner from the photosensitive member. The first door is rotatably supported by the main assembly and movable between a first closed position for closing the main assembly and a first open position for opening the main assembly to permit dismounting the cartridge from a the main assembly. The second door is rotatably supported by the main assembly at a position where it covers the first door. The second door is movable, independently of the first door, between a second closing closed position for closing the main assembly and a second opened position for uncovering the first door and for opening the main assembly. The second door is provided with a recess. When the first door is in the first open position, the recess of the second door in the second open position being capable of accommodating at least a part of the first door. The cartridge is capable of being inserted into the main assembly while sliding on the second door and then on the first door.

Further features of the present invention will become apparent from the following description of exemplary embodiments with reference to the attached drawings.

BRIEF DESCRIPTION OF THE DRAWINGS

FIG. 2 is a perspective view of the image forming apparatus shown in

FIG. 1.

Figure 6:
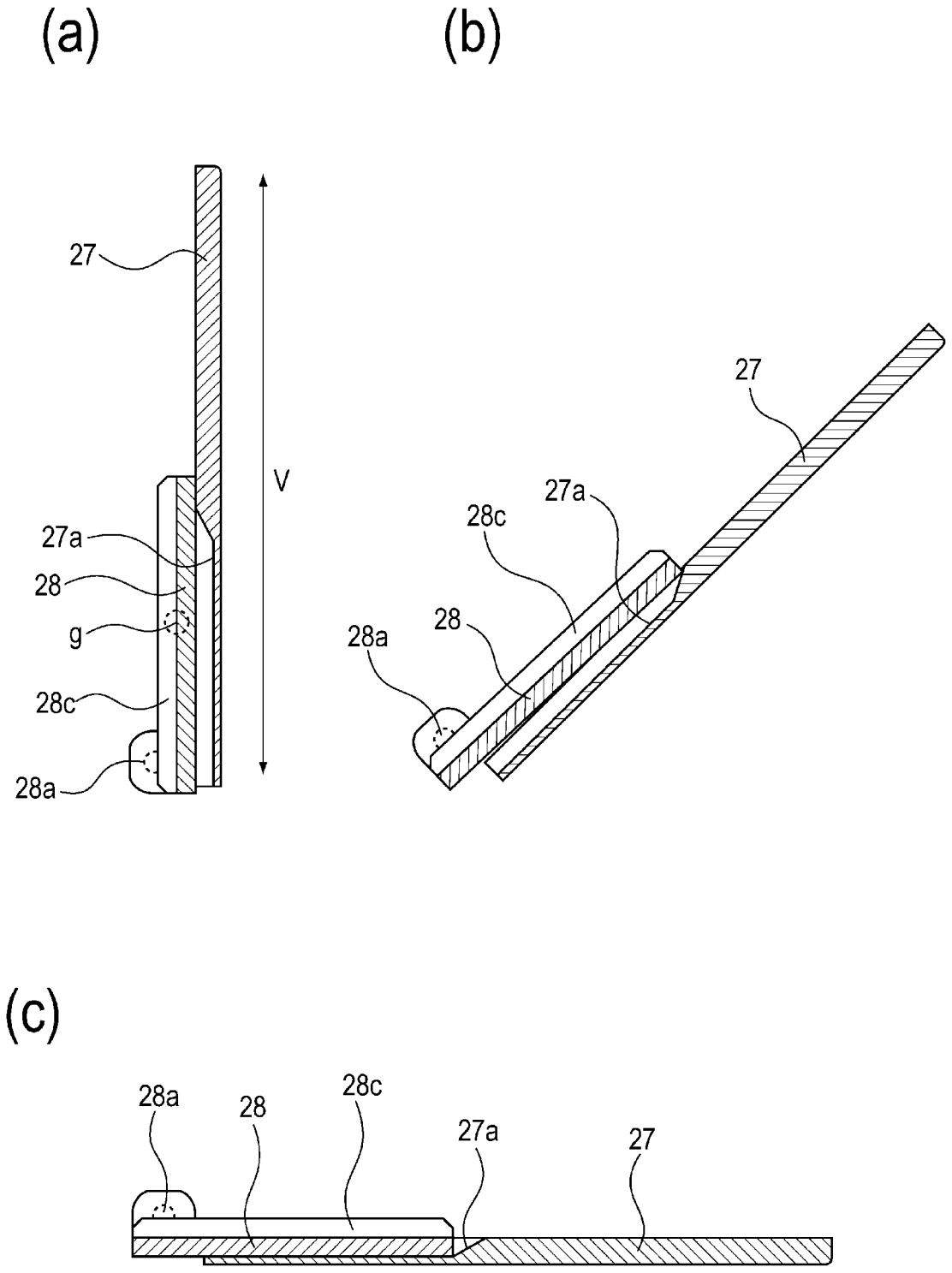

Parts (a), (b) and (c) of FIG. 6 are sectional views of a combination of the outer and inner doors.

Figure 7:
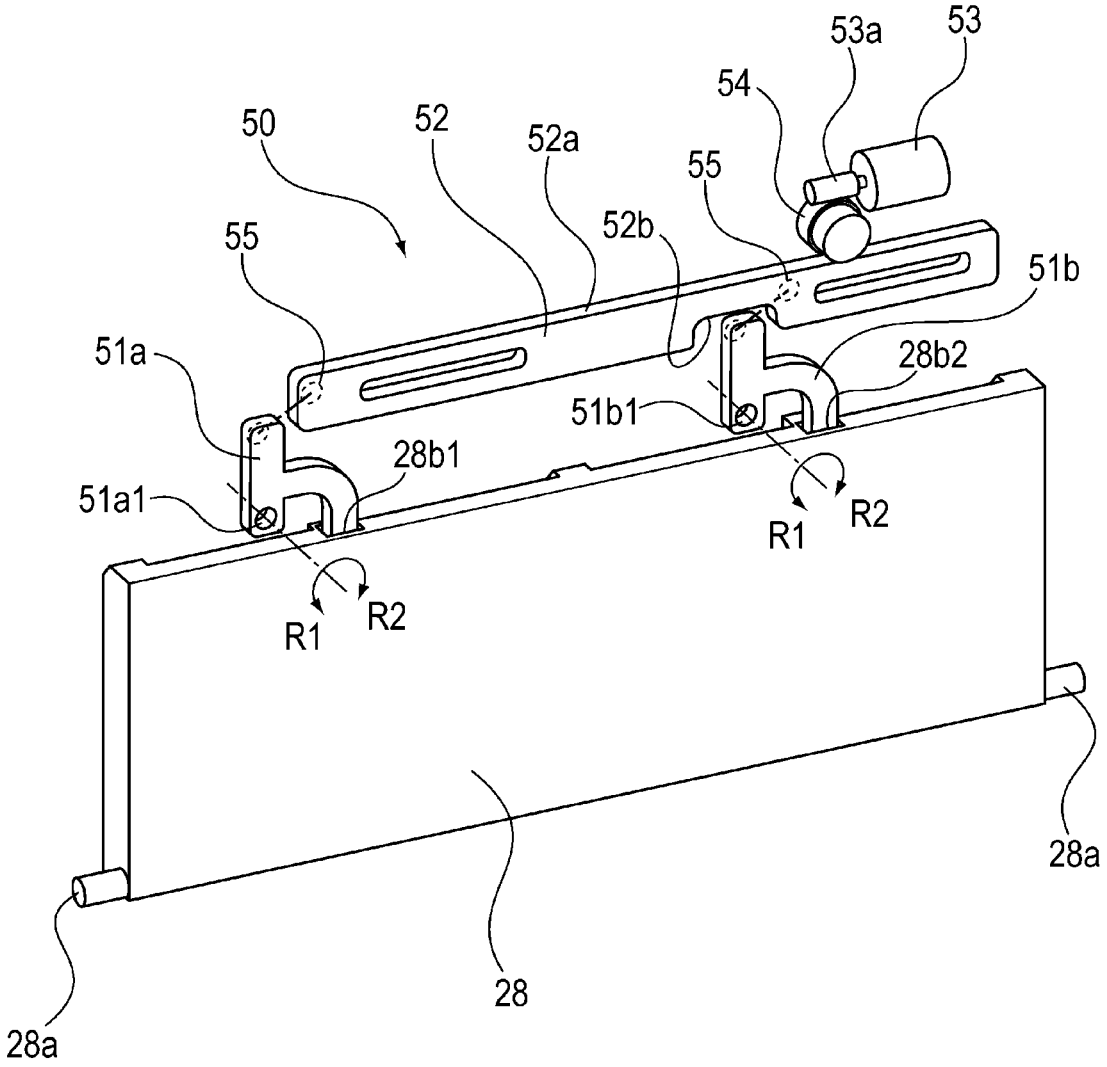

FIG. 7 is a perspective view of a combination of the inner door and locking mechanism.

Figure 8:
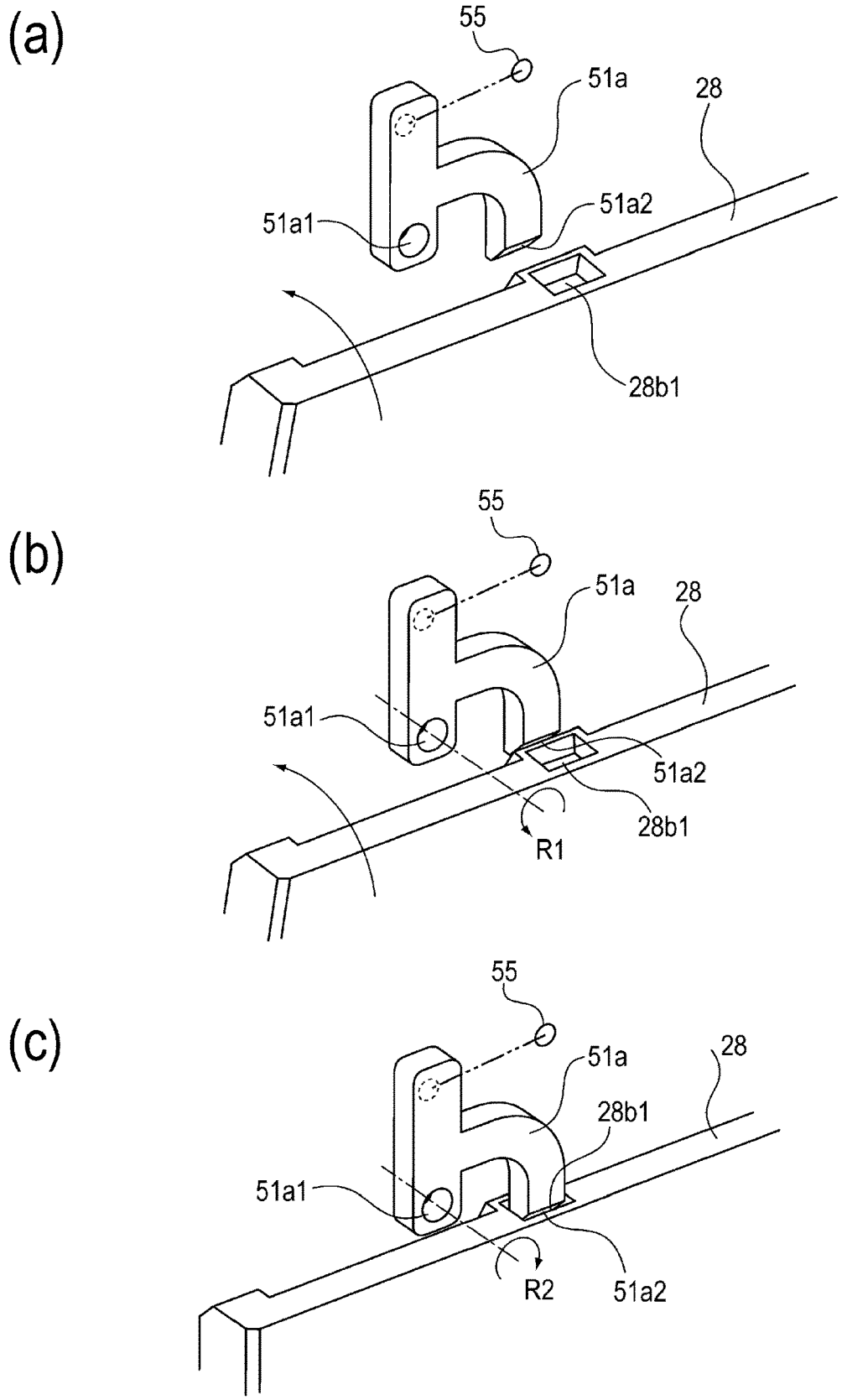

Parts (a), (b) and (c) of FIG. 8 are perspective views of a combination of the inner door and locking lever.

Figure 9:
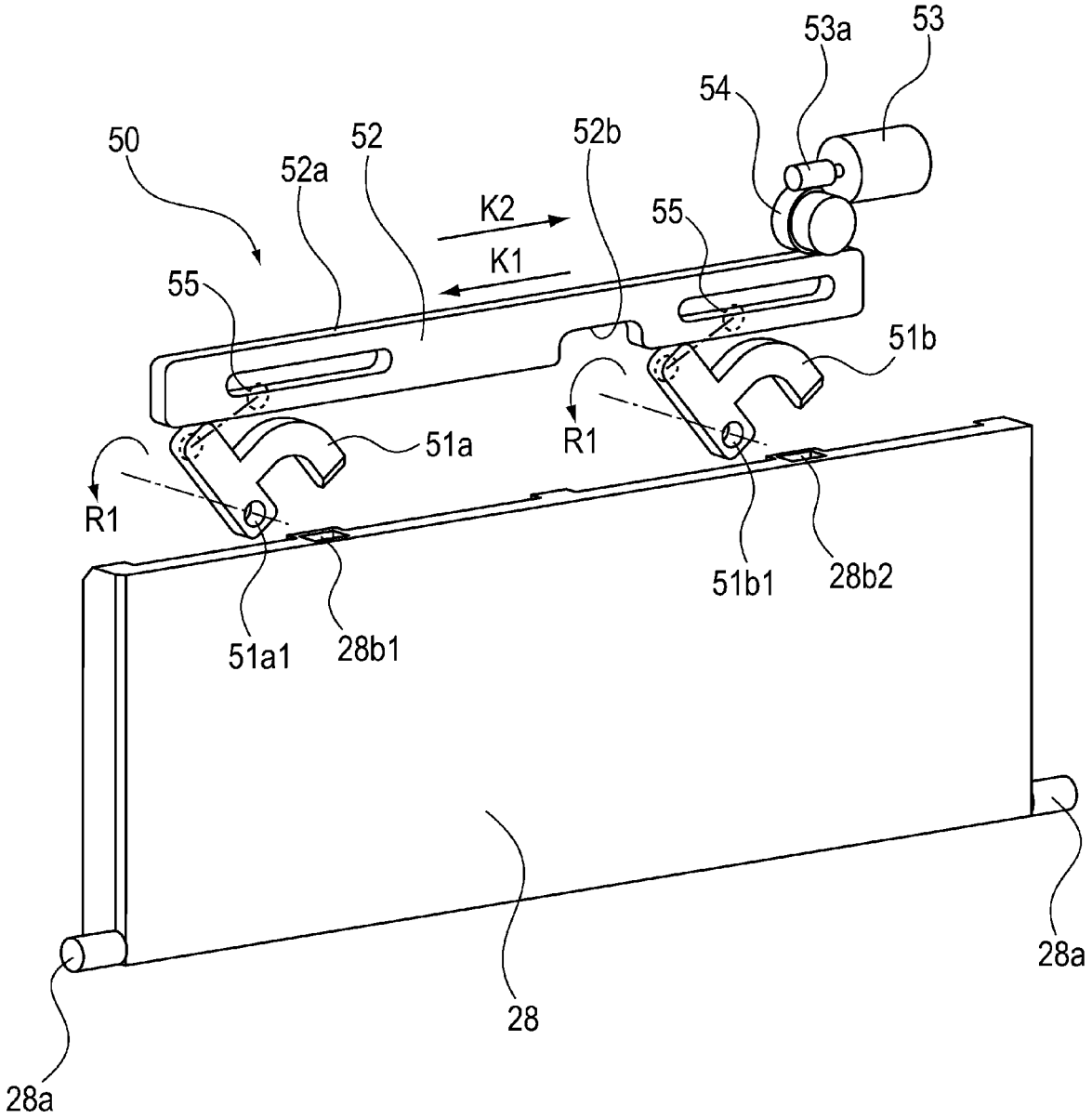

FIG. 9 is a perspective view of the combination of the inner door and locking mechanism.

Figure 10:
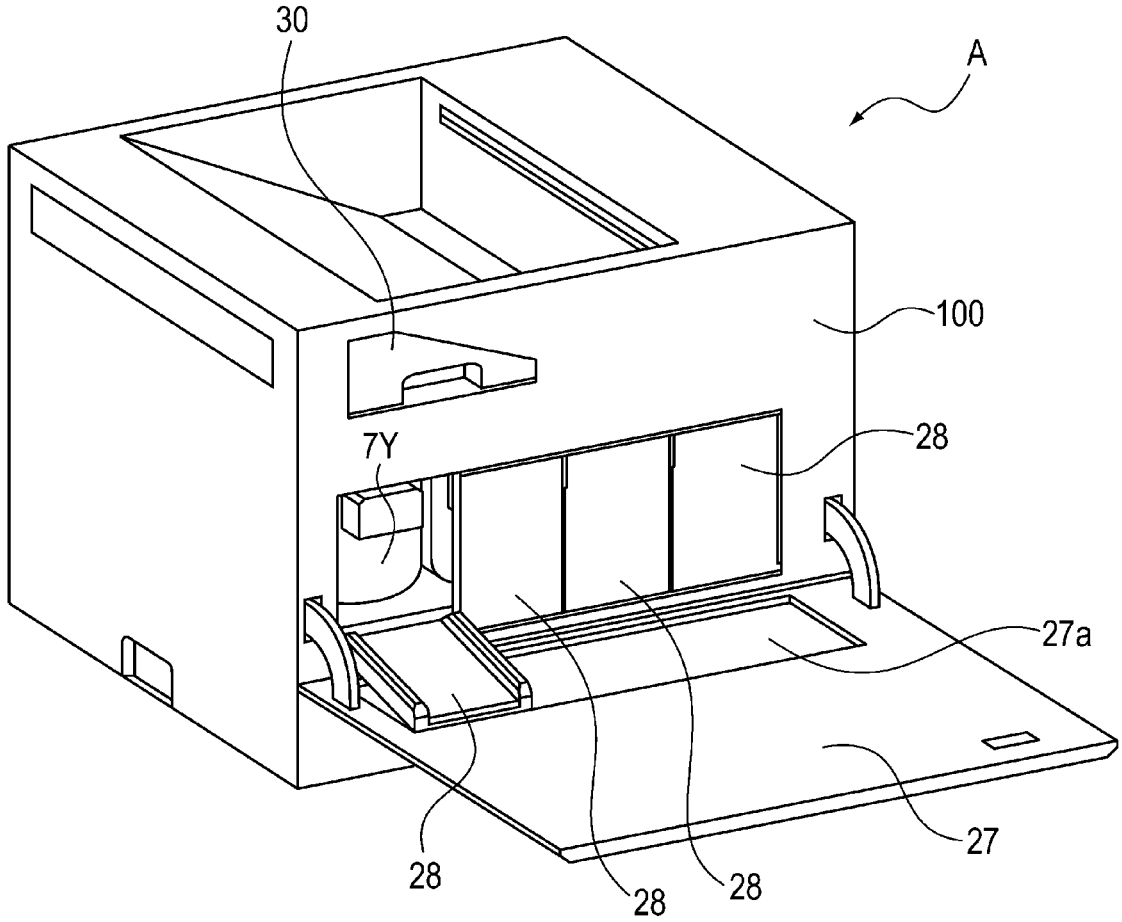

FIG. 10 is a perspective view of the image forming apparatus according to another embodiment of the present invention when both the outer and inner door are open.

DESCRIPTION OF THE EMBODIMENTS

Embodiment 1

<Image Forming Apparatus>

First, the overall structure of the image forming apparatus in the first embodiment of the present invention, and the image forming operation of the apparatus, are described with reference to appended drawings. By the way, the measurements, materials, and shapes of the structural components of this apparatus, and the positional relationship among the components, which are going to be described thereafter, are not intended to limit the present invention in scope, unless specifically noted.

The image forming apparatus A is of the so-called intermediary transfer type, and also, of the so-called tandem type. That is, it forms an image by transferring four toner images, which are different in color, more specifically, yellow (Y), magenta (M), cyan (C) and black (K) toner images, onto its intermediary transfer belt, and then, transfers the four toner images onto a sheet of recording medium. By the way, in the following description of the present invention, the referential codes for the members which use toners which are different in color, are given suffixes Y, M, C or K. However, they are practically the same in structure and operation, and are different only in the color of the toner they use. Therefore, in the following descriptions, the suffixes are not shown unless necessary.

Figure 1:
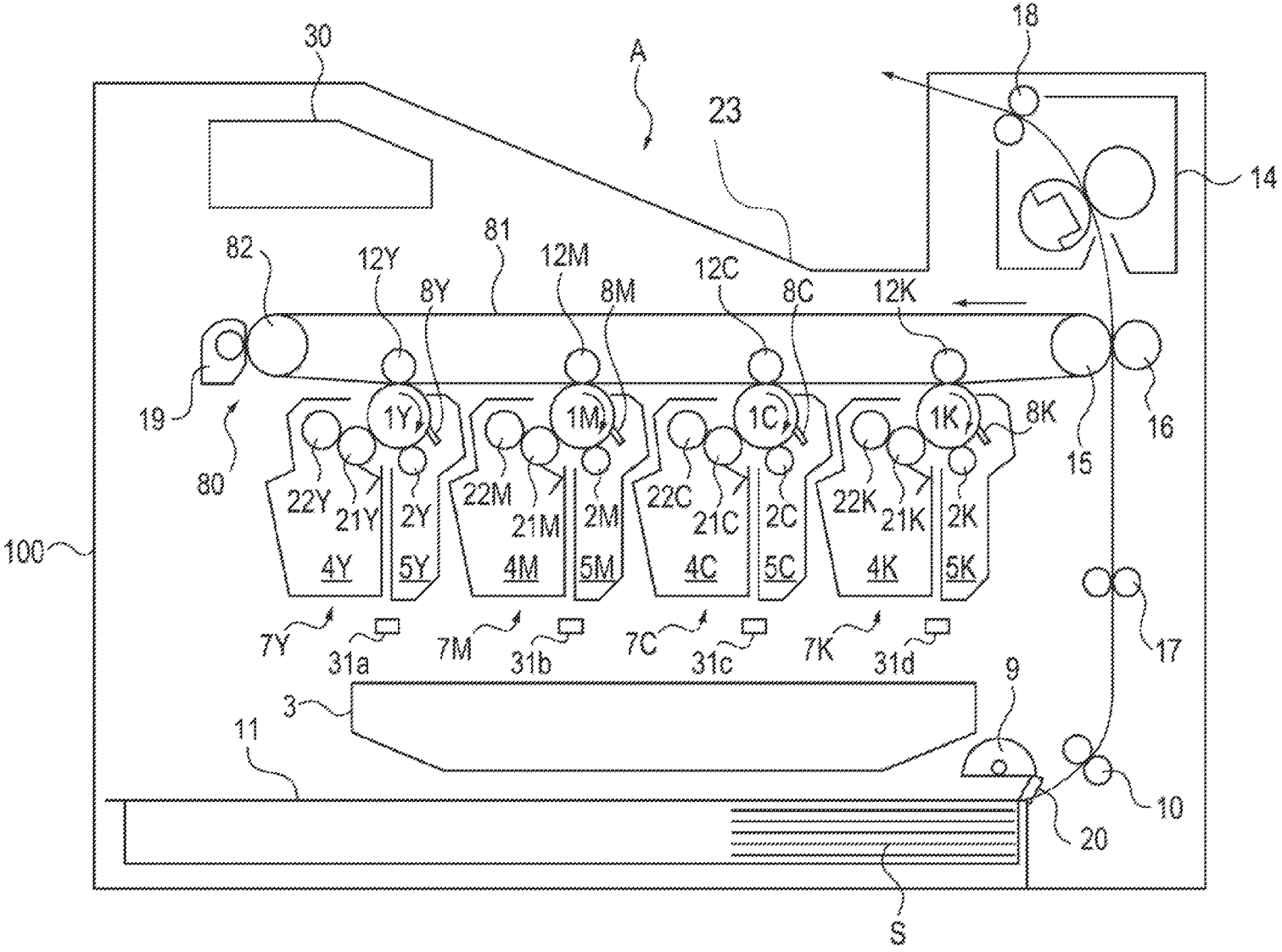
FIG. 1 is a schematic sectional view of an image forming apparatus in a first embodiment of the present invention.

FIG. 1 is a schematic sectional view of the image forming apparatus A. The image forming apparatus A has an image forming portion which forms toner images to be transferred onto a sheet of recording medium, a sheet conveying portion which conveys a sheet of recording medium toward the image forming portion, and a fixing portion which fixes the toner images to the sheet.

Referring to FIG. 1, the image forming portion employs process cartridges 7 (7Y, 7M, 7C and 7K). It has an intermediary transfer unit 80, and a laser scanner unit 3 as an exposing portion. The intermediary transfer unit 80 has an intermediary transfer belt 81, a tension roller 82, primary transfer rollers 12 (12Y, 12M, 12C and 12K), a secondary transfer roller 16 as a transferring member, a sheet backing roller 15 (which opposes secondary transfer roller 16), and a belt cleaner 19 as a cleaning unit.

The intermediary transfer belt 81, as an intermediary transferring member, is an endless belt. It is suspended and tensioned by a combination of the tension roller 82 and belt backing roller 15. It is kept tensioned by the tension roller 82. The intermediary transfer belt 81, as an intermediary transfer member, is rotated by the rotation of the belt backing roller 15 which is rotated by the driving force from an unshown motor. The belt cleaner 19, as a cleaning unit, is such a member that scrapes away the toner on the intermediary transfer belt 81.

The process cartridges 7 and image forming apparatus A are structured so that the former are removably installable in the main assembly 100 of the latter. Each process cartridge 7 comprises a development unit (4Y, 4M, 4C or 4K) and a drum unit 5 (5Y, 5M, 5C or 5K), which are integrally connected to each other.

The drum unit 5 has a photosensitive drum 1 (1Y, 1M, 1C or 1K) as a photosensitive member, a charge roller 2 (2Y, 2M, 2C or 2K), and a drum cleaner 8 (8Y, 8M, 8C or 8K) as a cleaning member. The drum cleaner 8 as a cleaning member is such a member that scrapes away the toner on the photosensitive drum 1 with its blade.

The development unit 4 has a development roller 21 (21Y, 21M, 21C or 21K), and a coating roller 22 (22Y, 22M, 22C or 22K). In the development unit 4, yellow, magenta, cyan and black toners are stored, respectively. These toners are coated on the development roller 21 by the corresponding coating roller 22.

Next, the image forming operation is described. As an unshown controlling portion of the image forming apparatus A receives an image formation job signal, the sheets S of recording medium stored in layers in a sheet cassette 11 are sent one by one to a pair of registration rollers 17 by a feed roller 9, and then, by a pair of conveyance rollers 10 while being separated from the rest by a separation pad 20. Then, each sheet S is conveyed to the secondary transferring portion formed by a combination of a secondary transfer roller 16 as a transferring member, and the sheet backing roller 15. By the way, the image forming apparatus A and sheet cassette are structured so that the latter can be removably inserted into the former, and also, so that the sheet cassette 11 is to be replenished with sheets by a user when the cassette 11 is out of the main assembly 100 of the image forming apparatus A.

Meanwhile, in the image forming portion, the photosensitive drum 1, as a photosensitive member, rotates in the counterclockwise direction by receiving driving force from the unshown motor. Then, as bias is applied to the charge roller 2, the peripheral surface of the photosensitive drum 1, which is in contact with the charge roller 2, is uniformly charged. Then, the laser scanner unit 3, as an exposing portion, projects a beam of laser light upon the peripheral surface of the photosensitive drum 1 as a photosensitive member, while modulating the beam with the image data transmitted thereto from an external device, or the like. Consequently, an electrostatic latent image, which is in accordance with the image data, is formed on the peripheral surface of the photosensitive drum 1 as a photosensitive member.

Thereafter, bias is applied to the development roller 21 which the development unit 4 has. As the bias is applied, toner is adhered to the electrostatic latent image on the peripheral surface of the photosensitive drum 1. As a result, a visible image is effected on the peripheral surface of the photosensitive drum 1 (this image is referred to as toner image, hereafter). After the formation of the toner image on the peripheral surface of the photosensitive drum 1 through the process described above, the toner image is sent to the primary transferring portion, which is formed by a combination of the photosensitive drum 1 and primary transfer roller 12.

As the toner images are sent into the primary transferring portion, they are transferred onto the intermediary transfer belt 81 as an intermediary transferring member by the bias applied to the primary transfer roller 12. By the way, the bias applied to the primary transfer roller 12 is opposite in polarity from the normal toner polarity. That is, four toner images, which are different in color, are sequentially transferred onto intermediary transfer belt 81 in layers. Consequently, a full-color toner image is effected on the intermediary transfer belt 81.

Thereafter, the toner image (full-color toner image) is sent to the secondary transferring portion by the rotation of the intermediary transfer belt 81. In the secondary transferring portion, bias is applied to the secondary transfer roller 16 as a transferring member. As the bias is applied, the toner image on the intermediary transfer belt 81 is transferred onto a sheet S of recording medium.

After the transfer of the toner image onto the sheet S, the sheet S is sent to the fixing apparatus 14, by which the sheet S and the toner image thereon are heated while being pressed. Consequently, the toner image becomes fixed to the sheet S. Then, the sheet S is discharged into a delivery portion 23 by a pair of discharge rollers 18.

By the way, after the transfer of the toner image from the photosensitive drum 1 onto the intermediary transfer belt 81 by the primary transfer roller 12, the toner which is remaining on the peripheral surface of the photosensitive drum 1 is scraped away by the drum cleaner 8 as a cleaning member. Similarly, after the transfer of the toner image from the intermediary transfer belt 81 onto a sheet S of recording medium, the toner which is remaining on the intermediary transfer belt 81, is scraped way by the belt cleaner 19 as a cleaning unit.

The toner removed from the photosensitive drum 1 and intermediary transfer belt 81 by the drum cleaner 1 as a cleaning member, and the belt cleaner 19 as a cleaning unit, respectively, are conveyed by an unshown toner conveyance system. Then, they are recovered into a container 30, as a storing member, for the recovered toner. The image forming apparatus A, and toner container 30 for the recovered toner, are structured so that the latter is removably installable in the former, making it possible for the container 30 to be replaced by an empty container 30 by a user or the like, as the amount of the recovered toner in the container 30 in the main assembly 100 of the image forming apparatus A reaches a preset value.

<Outer Door>

Next, the structure of an outer door 27 of the image forming apparatus A is described.

Figure 2:
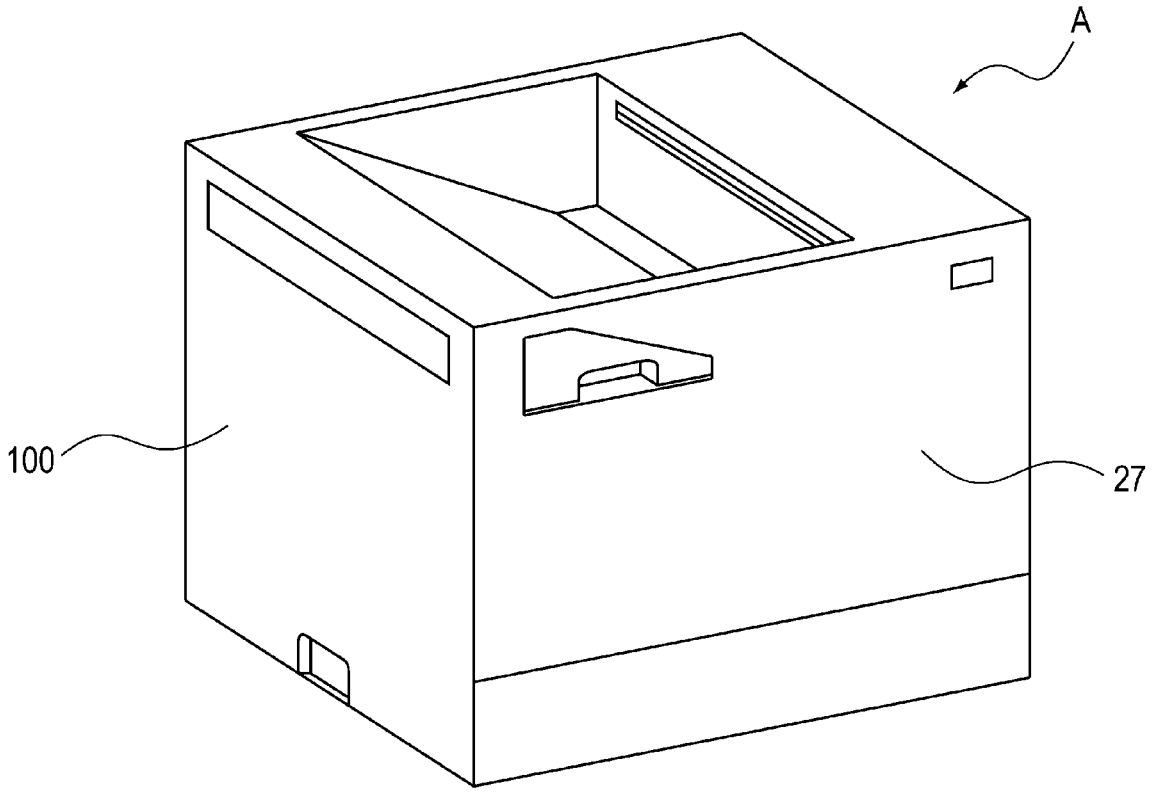
Figure 3:
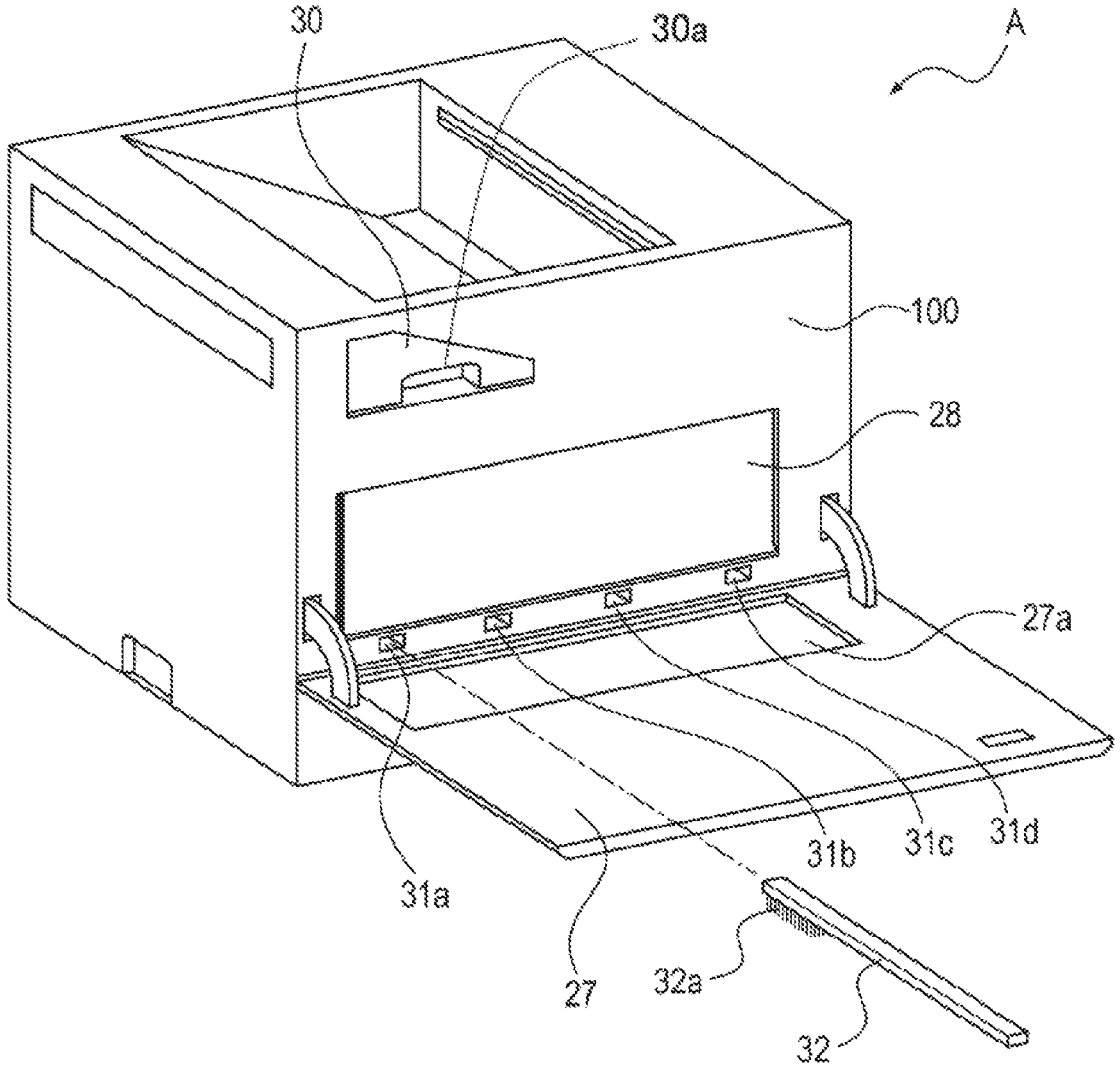
FIG. 3 is a perspective view of the image forming apparatus, when its outer door is open.

FIG. 2 is a perspective view of the image forming apparatus A. FIG. 3 is a perspective view of the image forming apparatus A when the outer door 27 is open.

Referring to FIGS. 2 and 3, the image forming apparatus A is provided with the outer door 27, as the second door, which can be pivotally opened away from, or closed against, the apparatus main assembly 100. The outer door 27 is pivotally supported by the apparatus main assembly 100 and enabled to be pivotally moved between the open position (second open position) and the closed position (second closed position).

As the outer door 27 (the second door) is opened, an inner door 28 (a first door), the container 30 for the recovered toner, and cleaning tool entrances 31 (31*a*-31*d*) are exposed. The inner door 28 (the first door) is for covering the process cartridges 7. Cleaning tools 32, as cleaning members, may be inserted through the cleaning tool entrances 31 (31*a*-31*d*). That is, when the outer door 27 is in the closed position, the inner door 28, the container 30 for the recovered toner, and entrances 31 for cleaning tools remain covered.

The cleaning tool 32 is provided with a brushing portion 32*a* which is one of the end portions of the cleaning tool 32. It is through the entrances 31 for the cleaning tool that the cleaning tool 32 can be insert into, or moved out of, the apparatus main assembly 100. The cleaning tool 32 is a part of the laser scanner unit 3. The cleaning tool 32 is used to remove the foreign substances on the glass dust cover (unshown), through which the aforementioned beam of laser light is projected upon the photosensitive drum 1. That is, if a user or a maintenance person wants to clean the glass dust cover, he or she is to open the outer door 27, and repeatedly insert or pull out the cleaning tool 32 through the cleaning tool entrance 31, so that the foreign substances on the transparent glass dust cover (unshown) is removed by the cleaning tool 32 to clean the transparent glass dust cover (unshown).

It is also the outer door 27 that is to be opened by a user or a maintenance person for them to replace the container 30 for the recovered toner in the apparatus main assembly 100 (to remove container 30 in apparatus main assembly 100, and insert an empty one). More concretely, as the amount of the recovered toner in the container 30 reaches a preset value, a user or a maintenance person is to remove the container 30 for the recovered toner from the apparatus main assembly 100 by grasping the handhold portion 30*a* of the container 30, and pulling the handhold portion 30*a* frontward of the apparatus main assembly 100. Then, they are to install a brand-new container for the recovered toner, or to install the removed container 30 after the removal of the recovered toner therein. This is how the container 30 for the recovered toner is to be replaced.

<Inner Door>

Next, the structure of the inner door 28 is described.

Figure 4:
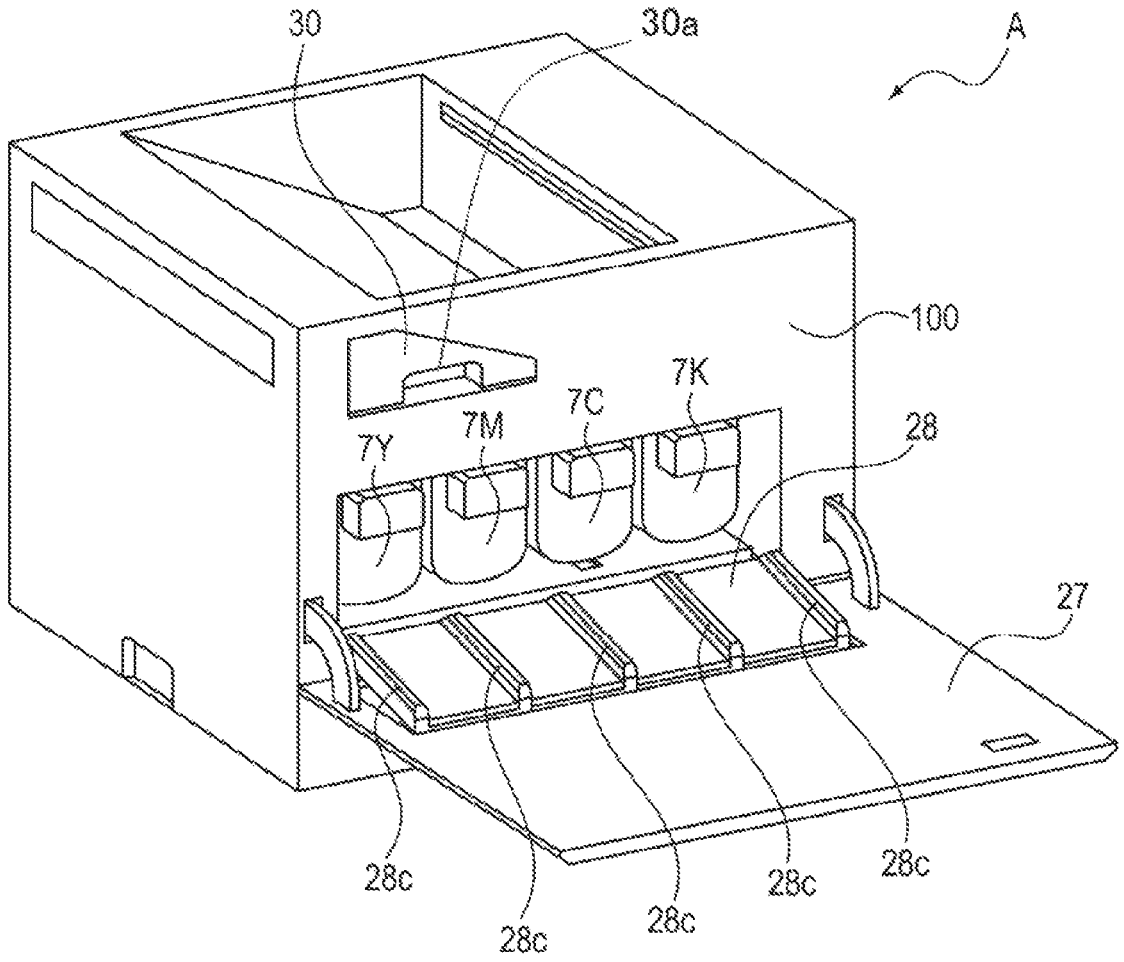
FIG. 4 is a perspective view of the image forming apparatus when both the outer and inner doors are open.
Figure 5:
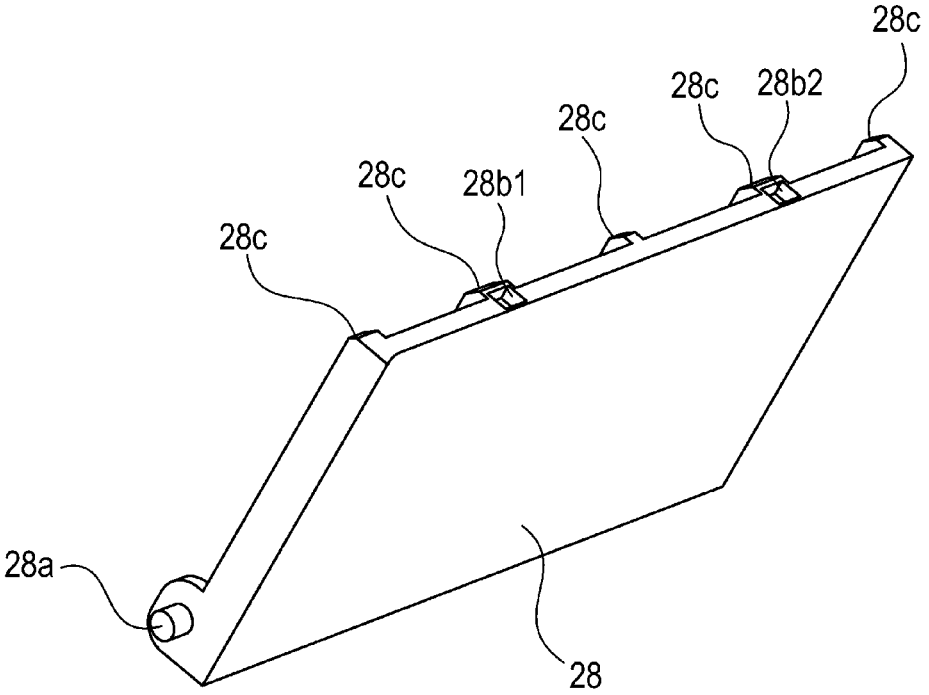
FIG. 5 is a perspective view of the inner door.

FIG. 4 is a perspective view of the image forming apparatus A when both the outer and inner doors 27 and 28 are open. FIG. 5 is a perspective view of the inner door 28. Referring to FIGS. 4 and 5, the inner door 28 is supported by the apparatus main assembly 100, by its supporting shaft 28*a*, and enabled to move between its open position (first open position) and its closed position (first closed position). That is, the outer door 27 and the inner door 28 of the image forming apparatus A are structured so that the two doors 27 and 28 are enabled to be independently moved between their open and closed positions. When the inner door 28 is in its open position, the process cartridges 7 remain exposed, enabling a user or a maintenance person to insert the process cartridges 7 into the apparatus main assembly 100 or extract the process cartridge 7 from the apparatus main assembly 100 to replace one or more process cartridges.

The opposite edge of the inner door 28 from the supporting shaft 28*a* is provided with a pair of grooves 28*b*1 and 28*b*2, which are recessed in the direction perpendicular to the primary surfaces of the inner door 28.

Further, the inward surface of the inner door 28 is provided with five guiding ribs 28*c* as portions for guiding the process cartridge 7. Thus, when a user or a maintenance person inserts the process cartridge 7 into the apparatus main assembly 100, or uninstalls the process cartridge 7 from the apparatus main assembly 100, they can move the process cartridge 7 along the guiding ribs 28*c*, making it easier to install or uninstall the process cartridge 7.

Parts (a), (b) and (c) of FIG. 6 are sectional views of the combination of the outer door 27 and inner door 28. Referring to part (a) of FIG. 6, the center g of gravity of the inner door 28 is on the outward side of the supporting shaft 28*a* in terms of the vertical direction (indicated by arrow mark V). Therefore, the inner door 28 remains under the moment generated by its own weight in the direction to open the inner door 28. However, when the outer door 27 is in its closed position, the inner door 28 is in contact with the outer door 27, being thereby prevented from pivotally moving in the opening direction. Therefore, it remains in the position in which it remains closed.

Next, referring to part (b) of FIG. 6, as the outer door 27 is moved from the closed position to the open position, the outer door 27 stops preventing the inner door 28 from pivoting in the opening direction. Consequently, the inner door 28 pivotally moves from the closed position to the open position, following the outer door 27.

Thereafter, as both the outer door 27 and inner door 28 are fully opened as shown in part (c) of FIG. 6, a part of the inner door 28 is stored into the recess 27*a* formed in the inward surface of the outer door 27. That is, as the outer door 27 is opened, at least a part of the inner door 28 is stored in the recess 27*a* of the outer door 27. Therefore, not only is the inner door 28 properly positioned in its open position, but also, the surface of the inner door 28, on which the process cartridge 7 slides when the process cartridge 7 is installed or uninstalled, is made level with the surface of the outer door 27, on which the process cartridge 7 slides when the process cartridge 7 is installed or uninstalled. Therefore, when the process cartridge 7 is installed, it smoothly slides onto the inner door 28 from the outer door 27. In other words, this embodiment can improve the image forming apparatus A having the outer door 27 and inner door 28 which are independently opened or closed from each other, in maintenance efficiency. By the way, it is not mandatory that when a part of the inner door 28 is stored in the recess 27*a* of the outer door 27, the surface of the outer door 27, on which the process cartridge 7 slides, is perfectly level with the surface of the inner door 28, on which the process cartridge 7 slides. That is, all that is necessary is that the image forming apparatus A is structured so that when the process cartridge 7 is inserted, the process cartridge 7 is allowed to smoothly slide onto inner door 28 from the outer door 27.

Further, the rotational axis (pivot) of the outer door 27 is on the outward side of the rotational axis (pivot) of the inner door 28. Therefore, as the outer door 27 is pivotally moved from its open position to its closed position, the inner door 28 comes into contact with the slanted surface of the recess 27*a* of the outer door 27, which is a part of the outer door 27, and then, pivotally moves from its open position to its closed position together with the outer door 27.

Since the image forming apparatus A is structured so that the movement of the inner door 28 is caused by the outer door 27 as described above, it is unnecessary for a user to open or close the inner door 28. Thus, this embodiment can increase the image forming apparatus A in the efficiency with which the process cartridge 7 can be replaced.

<Locking Mechanism>

Next, a locking mechanism 50 for locking the inner door 28 to the apparatus main assembly 100 is described.

FIG. 7 is a perspective view of a combination of the inner door 28 and locking mechanism 50. Parts (a), (b) and (c) of FIG. 8 are perspective views of a combination of the inner door 28 and a lock lever 51*a*. Part (a) of FIGS. 8, 8(*b*) and 8(*c*) show step by step the operational sequence through which the inner door 28 is locked by the locking mechanism 50.

Referring to FIG. 7, the locking mechanism 50 comprises two lock levers 51 (51*a* and 51*b*), a rack 52, a motor 53, a gear 54, and a spring 55. The lock levers 51*a* and 51*b* are supported in such a manner that they are rotationally movable in the directions indicated by arrow marks R1 and R2, about rotational axes 51*a*1 and 51*b*1, respectively. Further, the lock levers 51*a* and 51*b* are under the pressure generated by the spring 55 in the direction indicated by the arrow mark R2. Further, the gear portion 53*a* of the motor 53 is in mesh with the gear 54. The gear portion 52*a* of the rack 52 is in mesh with the gear 54.

Referring to part (a) of FIG. 8, when the inner door 28 is not in its closed position, the lock lever 51*a* is not in the groove 28*b*1 of the inner door 28, and the inner door 28 is not locked.

Referring to part (b) of FIG. 8, as the inner door 28 begins to be closed, it comes into contact with the slanted surface 51*a*2 of the lock lever 51*a*. As the inner door 28 is closed further, the lock lever 51*a* begins to be made to rotate in the direction indicated by the arrow mark R1 against the resiliency of the spring 55 by the inner door 28, with its slanted surface 51*a*2 sliding on the edge of the inner door 28. Then, as the inner door 28 is closed further, the lock lever 51*a* rotationally moves in the direction indicated by the arrow mark R1.

Next, referring to part (c) of FIG. 8, as the inner door 28 is closed further, the lock lever 51*a* is made to move onto the top end surface of the inner door 28, by its slanted surface 51*a*2. Then, as the inner door 28 is completely closed, the tip portion of the lock lever 51*a* settles in the groove 28*b*1 and engages with the inward surface of the groove 28*b*1. By the way, in the description given above, only the movement of the lock lever 51*a* was described. However, the lock lever 51*b* is the same in movement as the lock lever 51*a*, and fits into the grooves 28*b*2.

As the inner door 28 is closed, the lock levers 51*a* and 51*b* fit into the grooves 28*b*1 and 28*b*2, respectively, of the inner door 28 as described above. Therefore, when the inner door 28 is in its closed position, it remains locked to the apparatus main assembly 100 by the locking mechanism 50. By the way, when the inner door 28 remains locked to the apparatus main assembly 100, the lock lever 51*a* remains in the position in which it remains separated from the rack 52, whereas the lock lever 51*b* remains in the recess 52*b* of the rack 52.

Next, referring to FIG. 9, the process for unlocking the inner door 28 from the apparatus main assembly 100 by the locking mechanism 50 is as follows: First, the motor 53 is driven by the control from the unshown controlling portion. As the motor 53 is driven, the driving force from the motor 53 is transmitted to the rack 52 by way of the gear 54. Thus, the rack 52 moves in the direction indicated by an arrow mark K1.

As the rack 52 moves in the direction indicated by the arrow mark K1, the rack 52 comes into contact with the lock levers 51*a* and 51*b*. As the rack 52 moves, the recess 52*b* of the rack 52 also moves. Therefore, the inward side wall of the recess 52*b* of the rack 52 comes into contact with the lock lever 51*b*.

As the rack 52 is moved further in the direction indicated by the arrow mark K1 (horizontal direction) by the driving force from the motor 53, it presses the lock levers 51*a* and 51*b* in the direction indicated by the arrow mark K1, causing the lock levers 51*a* and 51*b* to rotationally move in the direction indicated by the arrow mark K1, against the pressure generated by the spring 55 in the direction indicated by the arrow mark R2. As the lock levers 51*a* and 51*b* rotationally move, the lock levers 51*a* and 51*b*, as engaging members, disengage from the grooves 28*b*1 and 28*b*2 of the inner door 28, which are in engagement with the lock levers 51*a* and 51*b*. That is, the inner door 28 is unlocked from the apparatus main assembly 100.

If it is wanted to lock the inner door 28 by the locking mechanism 50 while the inner door 28 is remaining closed, the following procedure is to be followed. First, the motor 53 is to be rotated in the opposite direction from when it is wanted to unlock the inner door 28. As the motor 53 is rotated, the rack 52 (movable member) is moved by the driving force from the motor 53, in the direction indicated by the arrow mark K2, which is opposite from the direction indicated by the arrow mark K1. Consequently, the rack 52 returns to the position shown in FIG. 7, making it possible for the lock levers 51*a* and 51*b* to move. Therefore, the lock levers 51*a* and 51*b* are rotationally moved by the pressure from the spring 55, in the direction indicated by the arrow mark R2, and engage into the grooves 28*b*1 and 28*b*2, respectively, of the inner door 28.

That is, it is by the pressure from the spring 55 that the lock levers 51*a* and 51*b* are rotationally moved from the positions in which they are not fitted in the grooves 28*b*1 and 28*b*2, respectively. However, when the lock levers 51*a* and 51*b* move from the positions in which they are fitted in the groove 28*b*1 and 28*b*2, to the positions in which their tips are not in the grooves 28*b*1 and 28*b*2, respectively, they move by being pressed by the rack 52 which is moved by the driving force from the motor 53. That is, the combination of the spring 55, motor 53, and rack 52 is a means for moving the lock levers 51*a* and 51*b* to the position in which the lock levers 51*a* and 51*b* are in engagement with the grooves 28*b*1 and 28*b*2, respectively, or the positions in which the former are not in engagement with the latter.

The timing with which the inner door 28 is unlocked from the apparatus main assembly 100 by the locking mechanism 50 is as follows. That is, the process cartridge 7 is provided with a sensor (unshown) as a means for detecting the amount of the toner in the development unit 4. If the amount of the toner detected by the unshown sensor is no more than a preset value, the unshown controlling portion unlocks the inner door 28 by driving the motor 53.

Being structured as described above, the image forming apparatus A is enabled to unlock the inner door 28 with such timing that the process cartridge 7 needs to be replaced. By the way, in this embodiment, the inner door 28 is unlocked according to the amount of the toner in the development unit 4. However, this embodiment is not intended to limit the present invention in scope in terms of when the inner door 28 is to be unlocked. For example, the image forming apparatus A may be structured so that the inner door 28 can be unlocked whenever a person in charge of the apparatus wishes.

As described above, according to this embodiment, the inner door 28 can be locked shut by the locking mechanism 50. Therefore, it is possible to regulate the replacement of the process cartridge 7. Further, as the outer door 27 is opened by a user or an operator, the image forming apparatus A becomes ready for the removal or installation of the container 30 for the recovered toner. Moreover, as a user or an operator opens the outer door 27, they are allowed to access the cleaning tool entrance 31 to clean the transparent glass dust cover (unshown) of the laser scanner unit 3. Therefore, not only is the image forming apparatus A prevented from being reduced in efficiency when the process cartridge 7 needs to replaced and/or its image forming portion needs to be maintained, but also, it is possible to regulate the replacement of the process cartridge 7.

By the way, in this embodiment, the image forming apparatus A was provided with only one inner door, or the inner door 28. However, this embodiment is not intended to limit the present invention in scope in terms of the number of the inner door 28. That is, the present invention is also applicable to an image forming apparatus which is provided with multiple inner doors 28, the number of which corresponds to the number of the multiple process cartridges 7 which it employs, and is structured so that the multiple inner doors 28 can be individually locked by the mechanism which is similar to the one in this embodiment, as shown in FIG. 10. In the case of this type of image forming apparatus, the replacement of the process cartridge 7 can be regulated based on the color of the toner in each process cartridge 7.

Further, in this embodiment, the image forming apparatus A was a full-color image forming apparatus which employs multiple process cartridges 7. This embodiment, however, is not intended to limit the present invention in scope in terms of the process cartridge count. That is, the present invention is also applicable to a monochromatic image forming apparatus which employs only one process cartridge 7. Such application can provide the similar effect to the one described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-023106 filed on Feb. 13, 2019, which is hereby incorporated by reference herein in its entirety.

What is claimed is:

1. An image forming apparatus comprising:

a cartridge detachably mountable to a main assembly of an image forming apparatus and including a photosensitive member and a cleaning member configured to remove toner from said photosensitive member;

a first door rotatably supported by said main assembly and movable between a first closed position for closing said main assembly and a first open position for opening said main assembly to permit dismounting said cartridge from said main assembly; and a second door rotatably supported by the main assembly, said second door being movable, independently of said first door, between a second closed position for closing said main assembly and covering said first door and a second opened position for opening said main assembly, said second door having a recess, said recess of said second door in the second open position being capable of accommodating at least a part of said first door when said first door is in the first open position, wherein said cartridge being capable of being inserted into the main assembly while sliding on said second door and then on said first door.

2. The image forming apparatus according to claim 1, wherein said first door is provided with a guiding portion capable of guiding movement of said cartridge.

3. The image forming apparatus according to claim 1, wherein said first door is supported by said second door, when the second door is in the the second open position and the first door is in the first open position.

4. The image forming apparatus according to claim 1, further comprising:

an exposing portion (i) having a transmitting portion configured to permit transmission of light and (ii) configured to expose said photosensitive member to the light; and a cleaning portion configured to allow cleaning said transmitting portion, said cleaning portion being covered by said second door when said second door is in the second closed position, and being uncovered when said second door is in the second open position.

5. The image forming apparatus according to claim 1, further comprising an accommodation member configured to accommodate the toner removed by said cleaning member, wherein when said second door is in the second closed position, said accommodation member is covered by said second door, and when said second door is in the second open position, said accommodation member is uncovered to permit said accommodation member to be dismounted from said main assembly.

6. The image forming apparatus according to claim 5, further comprising:

an intermediary transfer member configured to receive a toner image from said photosensitive member;

a transfer member configured to transfer the toner image from said intermediary transfer member onto a sheet;

a cleaning unit configured to remove the toner from said intermediary transfer member, wherein the toner removed by said cleaning unit is accommodated in said accommodation member.

7. The image forming apparatus according to claim 1, further comprising a locking mechanism configured to lock said first door relative to said main assembly when said first door is in the first closed position.

8. The image forming apparatus according to claim 7, wherein said locking mechanism includes an engaging portion configured to engage with an engaging portion provided on said first door to lock said first door relative to said main assembly, and a moving device configured to move said engaging portion between a position for engagement with said engaging portion and a position released from the engaged portion.

9. The image forming apparatus according to claim 8, wherein said moving device includes a motor, and a moving member capable of being moved by a driving force of said motor to move said engaging portion.

10. The image forming apparatus according to claim 9, further comprising:

a detector configured to detect an amount of the toner accommodated in said cartridge; and a controller configured to control said motor, said controller being configured to actuate said motor when the amount of the toner detected by said detecting is not more than a predetermined amount.

11. The image forming apparatus according to claim 7, wherein when said first door is not locked relative to said main assembly, said first door is moved from the closed position to the open position in interrelation with said second door when said second door moves from the closed position to the open position.

12. The image forming apparatus according to claim 1, wherein a plurality of such cartridges are mounted, and such first doors are provided for said cartridges, respectively.

13. The image forming apparatus according to claim 1, wherein, when the cartridge is installed or uninstalled, the guiding portion is made level with the surface of the second door on which the cartridge slides.

* * * * *